US007296498B1

(12) United States Patent
Kim

(10) Patent No.: US 7,296,498 B1
(45) Date of Patent: Nov. 20, 2007

(54) ATTACHED DISPOSABLE BOTTLE OPENER

(76) Inventor: Il Koo Kim, 67 Pleasant Valley Rd., Old Bridge, NJ (US) 08857

( * ) Notice: Subject to any disclaimer, the term of this patent is extended or adjusted under 35 U.S.C. 154(b) by 0 days.

(21) Appl. No.: 11/581,304

(22) Filed: Oct. 16, 2006

(51) Int. Cl.
*B67B 7/16* (2006.01)

(52) U.S. Cl. ..... 81/3.15

(58) Field of Classification Search ..... 81/3.15; 215/226, 295
See application file for complete search history.

(56) References Cited

U.S. PATENT DOCUMENTS

| | | | | | |
|---|---|---|---|---|---|
| 921,055 | A | * | 5/1909 | Aliber | 215/303 |
| 1,239,238 | A | * | 9/1917 | White | 215/305 |
| 1,725,726 | A | * | 8/1929 | Ament | 215/390 |
| 1,916,115 | A | * | 6/1933 | Perkins et al. | 81/3.15 |
| 1,978,272 | A | * | 10/1934 | Lawrence | 215/305 |
| 2,005,784 | A | * | 6/1935 | Harvey | 81/3.15 |
| 2,020,205 | A | * | 11/1935 | Perkins | 215/226 |
| 2,151,129 | A | * | 3/1939 | Markle | 215/305 |
| 2,337,241 | A | * | 12/1943 | Harvey et al. | 215/305 |
| 2,347,734 | A | * | 5/1944 | Cowan, Jr. | 81/3.15 |
| 2,750,062 | A | * | 6/1956 | Satz | 215/305 |
| 2,778,520 | A | * | 1/1957 | Hyde, Jr. | 215/253 |
| 2,848,131 | A | * | 8/1958 | Ward | 215/305 |
| 3,785,519 | A | * | 1/1974 | Huh | 215/254 |
| 5,265,746 | A | * | 11/1993 | Lee | 215/295 |
| 6,860,397 | B1 | * | 3/2005 | Walters, Jr. | 215/305 |
| 2007/0074604 | A1 | * | 4/2007 | Lipson | 81/3.15 |

* cited by examiner

*Primary Examiner*—David B Thomas

(57) ABSTRACT

The present invention provides an opener that attached to the side of the conventional crimped metal bottle cap. The high strength metallic bottle cap can be easily opened in safe shape by just pulling out outwardly using two fingers. Using by thermosetting plastic material, it can be attached to the bottle cap without a mechanical retention or adhesive agent. This opener is formed to the outline of the bottle cap and the upper bottle third. The ideal position of the fulcrum and the resistance portions of the present invention make the bottle cap to be opened within 20' degrees from the bottle neck and it causes below 20' degrees bent bottle cap that remains inside of the disposable opener. The present invention also can be formed in various ornamental designs within functional range.

9 Claims, 4 Drawing Sheets

ATTACHED DISPOSABLE BOTTLE OPENER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of bottle opener and more specifically to an attached disposable bottle opener to the conventional crimped steel bottle cap, in which suitable for brewed beers, ales and carbonated sodas.

In the present days, many kinds of caps are used to the bottles. A certain type of bottle cap is used depending on type of bottle. For instance, tear off type is used for a milk and water; twist off type is used for sodas; and crimped steel bottle cap is used for beer and carbonate beverage to keep certain level of pressure of the contents. The crimped steel bottle cap needs a specialized tool, opener, which based on a leverage to remove the steel bottle cap from the bottle. Since the crimped steel bottle cap has emerged to the market, the bottle opener has become one of the important daily necessaries to the people in the house restaurant and other places. However, most people must have had inconvenient experiences with the crimped steel bottle cap without a opener at indoors, especially out doors. It must had been a harder experience to the women and elders to open the crimped steel bottle cap without using a proper opener. Furthermore, using the conventional opener makes a sharp projection to the steel bottle cap and the sharply fold bottle cap can be a factor of hazard to the people, especially to children and toddlers. They can be cut or may step on it with a bare foot. The neglected sharply bent steel cap is dangerous object to the toddlers who are apt to put a things into their mouth.

BRIEF SUMMARY OF THE INVENTION

The primary object of the invention is to provide a overcome from disadvantageous practice with conventional crimped metal bottle cap. Another object of the invention is to prevent a possible hazard that sharply L shaped fold metal bottle cap. Present invention causes the crimped metal bottle cap to be opened in a safe shape. A further object of the invention is to provide people convenience. They can open crimped metal bottle caps any place at any time with the present invention.

Other objects and advantages of the present invention will become apparent from the following descriptions, taken in connection with the accompanying drawings, wherein, by way of illustration and example, an embodiment of the present invention is disclosed. In accordance with a preferred embodiment of the invention, there is disclosed an article of manufacture for attached bottle opener comprising:

The present invention is attached to the crimped metal bottle cap in juxtaposition without mechanical retention or adhesive agent. It operates by ideal positions of fulcrum and resistance of a leverage for the purpose of opening the crimped metal bottle cap in safe shape with minimal efforts. Further in accordance with the invention, this device can be made in various forms using resilient plastic material.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
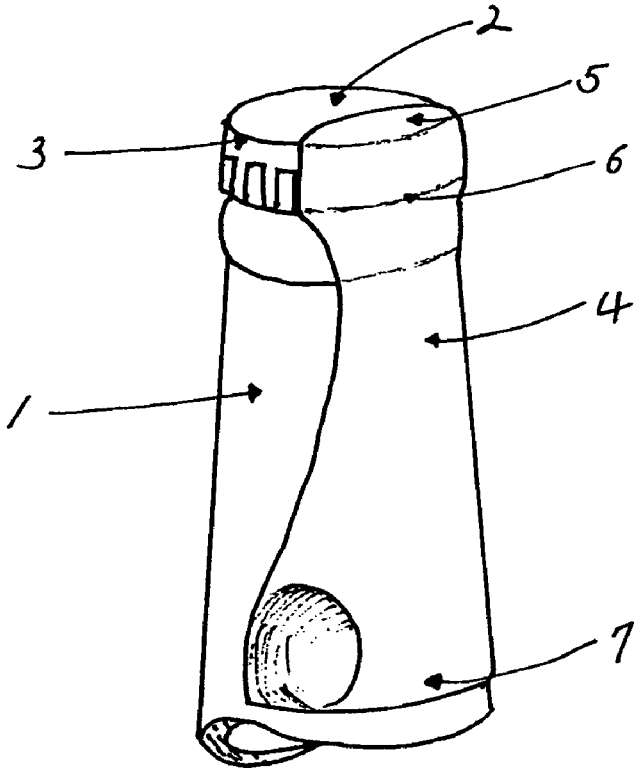
FIG. 1. is a perspective view of the device of the invention.
Figure 2:
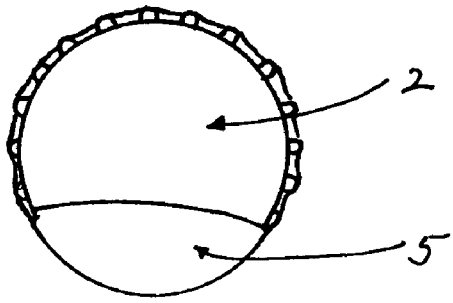
FIG. 2. is a plane view of the device of the invention.
Figure 3:
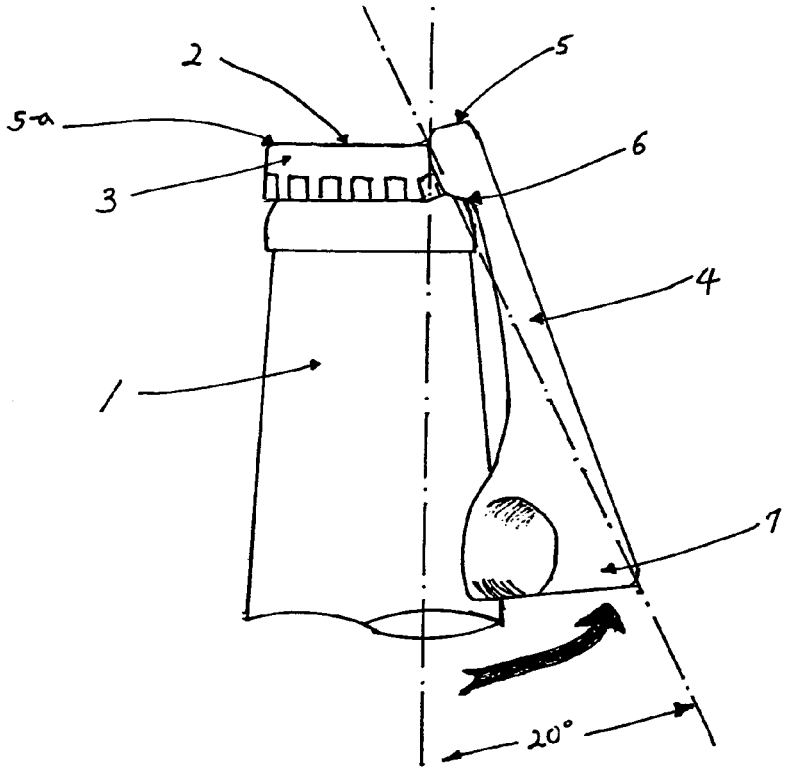
FIG. 3. is a side view of the device in the open position.
Figure 4:
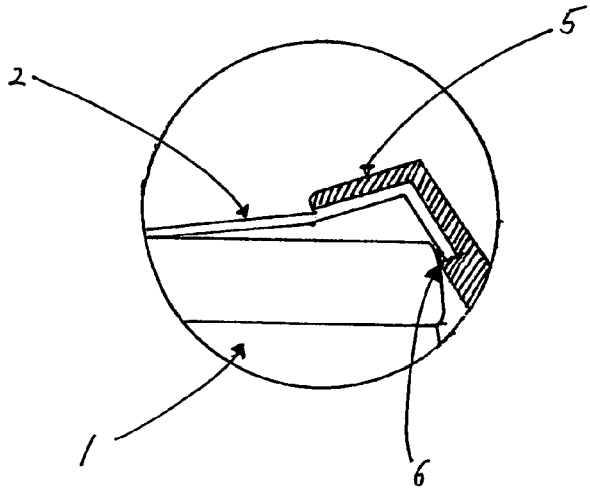
FIG. 4. is an enlarged schematic view of #6 in FIG. 3.
Figure 5:
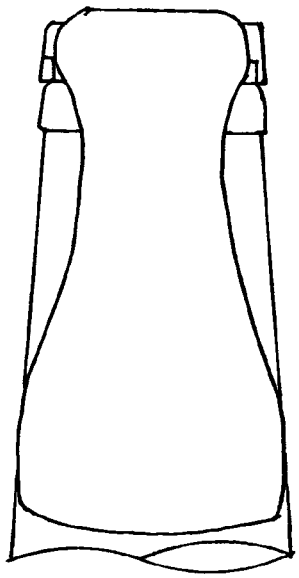
FIG. 5 is a frontal view of the invention.
Figure 6:
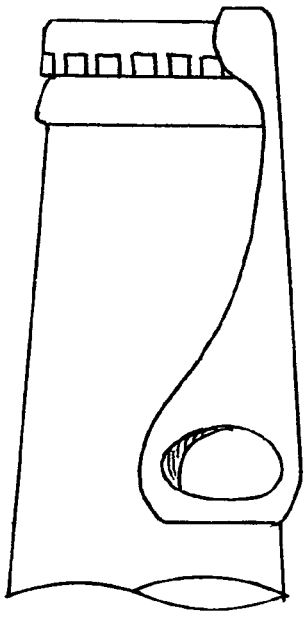
FIG. 6. is a side view of the second embodiment.
Figure 7:
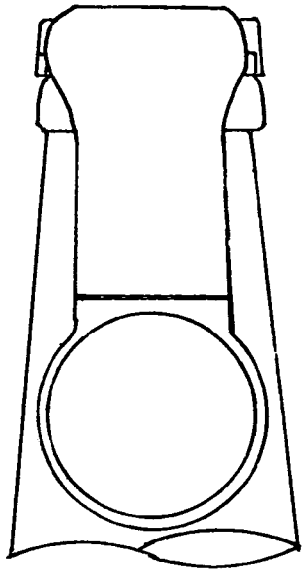
FIG. 7. is a frontal view of the third embodiment.
Figure 8:
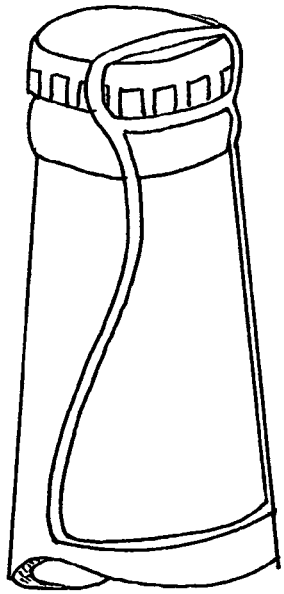
FIG. 8. is a perspective view of the fourth embodiment.

Upon inspection of FIG. 1, it will be seen that the preferred embodiment comprises with three functional portions of a leverage; a fulcrum portion 5, a resistance portion 6 and effort portion 7. The operation of the invention may be understood upon reference to FIG. 3. When the user desires to open the bottle cap 2 from the bottle 1, the user simply pulls the effort portion 7 outwardly and upwardly. Then 5 begins to fulcrum against the top wall 2, and cause the resistance to the portion 6 to completely separate from the cap 2 from the bottle 1. The resistance portion should hold about seven corrugations of bottle cap to get intended result. During the opening process, as the cap opens, the fulcrum gets to shift from 5 to 5*a*. As a consequence, it causes the bottle cap separates within 20' degrees from the bottle neck by the leverage as shown in FIG. 3. It is evident that the conventional opener cause almost L shaped bottle cap because of the locked fulcrum which is positioned at the middle of crimped bottle cap. Thus, it is seen that a relatively small efforts required to open the crimped metal bottle cap using present invention. In this way, the preferred material is a PVC or other thermoplastic which are resilient at the temperatures. The thermosetting material penetrates into the corrugated flanges of the bottle cap during the heat sealing or induction sealing process. The manufacturer can simply apply the present invention just attaching to the conventional bottle cap. Moreover, various shape can be made within functional range. If an artistic consideration applies, the present invention can be formed as symbolically or ornamentally. Turning to FIG. 1, the effort portion 7 of the opener is formed as finger index to increase opening force. In accordance with the present invention, FIG. 6 illustrates a second embodiment of the present invention; and in this embodiment, the effort portion has hollow shaped figure to receive fingers. In the FIG. 7, it illustrates a third embodiment of the present invention; and in this embodiment, the effort portion has a ring shape and has impressed notch, so the user can fully insert a finger into the ring portion after bent the end of the opener. In the FIG. 8, it illustrates a forth embodiment of the present invention; and in this invention, the configuration is formed as a manner of the first embodiment with a metallic wire.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A disposable bottle opener comprising:

a fulcrum portion, said fulcrum portion adapted to attach to one-fifth of a top surface of a bottle cap;

a resistance portion adapted to engage a predetermined portion of a lower surface of said bottle cap beneath a portion of said bottle cap attached to said fulcrum portion, an effort portion integral with said fulcrum portion and said resistance portion, said effort portion adjacent to said bottle, said effort portion conforming to an outline of an upper third of a neck of said bottle, said effort portion widens from said resistance portion to a base wherein during opening of said bottle cap said resistance portion moves within 20 degrees from said neck of said bottle.

2. The bottle opener of claim 1, wherein said effort portion has a concave finger indexes at an end of each side of said effort portion.

3. The bottle opener of claim 1, wherein said effort portion further comprises finger receiving holes at an end of each side of said effort portion.

4. The bottle opener of claim 1, wherein said effort portion, further comprises a ring shape at an end thereof and an impressed notch above the ring shape.

5. The bottle opener of claim 1, wherein said opener is formed by a metallic wire.

6. The bottle of claim 1 wherein said resistance portion engages seven corrugations of said bottle cap.

7. The bottle opener of claim 1, wherein said the fulcrum portion has a round shape.

8. The bottle opener of claim 1, wherein said fulcrum is located above eight corrugations of said bottle cap.

9. The bottle opener of claim 1, wherein said resistance portion engages into seven corrugations of said bottle cap.

* * * * *